US006766034B2

(12) United States Patent
Kobayashi et al.

(10) Patent No.: US 6,766,034 B2
(45) **Date of Patent: *Jul. 20, 2004**

(54) MULTIFUNCTION ACOUSTIC DEVICE

(75) Inventors: Takashi Kobayashi, Yamanashi-ken (JP); Akira Nikaido, Tokyo (JP)

(73) Assignee: Citizen Electronics Co., Ltd., Yamanaski-ken (JP)

( * ) Notice: Subject to any disclaimer, the term of this patent is extended or adjusted under 35 U.S.C. 154(b) by 306 days.

This patent is subject to a terminal disclaimer.

(21) Appl. No.: 09/950,601

(22) Filed: Sep. 13, 2001

(65) Prior Publication Data

US 2002/0033681 A1 Mar. 21, 2002

(30) Foreign Application Priority Data

Sep. 21, 2000 (JP) ..... 2000-286414

(51) Int. Cl.[7] ..... H04R 25/00

(52) U.S. Cl. ..... 381/396; 381/401; 381/421

(58) Field of Search ..... 381/151, 152, 381/396, 401, 421, 431; 340/384.72, 384.73, 407.1, 693.5

(56) References Cited

U.S. PATENT DOCUMENTS 6,611,605 B2 * 8/2003 Kim ..... 381/396
6,621,911 B2 * 9/2003 Kobayashi et al. ..... 381/396

* cited by examiner

*Primary Examiner*—Suhan Ni
(74) *Attorney, Agent, or Firm*—Dennison, Schultz, Dougherty & MacDonald

(57) ABSTRACT

A speaker vibrating plate having a voice coil secured thereto is provided in a frame, a rotor having an annular side yoke is rotatably supported in the frame, and a stator having poles is provided in the frame. A first permanent magnet is provided on the rotor at a central portion thereof, and an annular second permanent magnet is mounted on the rotor outside the side yoke for forming a magnetic circuit passing through the rotor and the stator, and a stator coil is provided in the stator. A driving circuit is provided for energizing the stator coil for rotating the rotor.

12 Claims, 7 Drawing Sheets

MULTIFUNCTION ACOUSTIC DEVICE

BACKGROUND OF THE INVENTION

The present invention relates to a multifunction acoustic device used in a portable instrument such as a portable telephone.

There has been provided an acoustic device of the portable instrument in which a speaker is provided for generating sounds of calling signals, and a vibrating motor is provided for informing the receiver of calling signals without generating sounds. In such a device, since both of the speaker and the motor are mounted in the device, the device is increased in size and weight, and in manufacturing cost.

In recent years, there is provided a multifunction acoustic device in order to remove the above described disadvantages. The multifunction acoustic device comprises a speaker having a vibrating plate and a permanent magnet magnetically connected to a voice coil mounted on the vibrating plate of the speaker. The permanent magnet is independently vibrated at a low frequency of 100–150 Hz so as to inform the receiving of calling signals by the vibration of the case of the device, which is transmitted to the body of the user of the device.

FIG. 6 is a sectional view of a conventional electromagnetic induction converter disclosed in Japanese Patent Laid Open 5-85192. The converter comprises a diaphragm 506 mounted in a case 512 at a periphery thereof, a voice coil 508 secured to the underside of a central portion 507 of the diaphragm 506, a spring plate 511 mounted in the case 512, and a permanent magnet 510 secured to a central portion of the spring plate 511, inserted in the voice coil 508.

By applying a low or high frequency signal to the voice coil 508, the spring plate 511 is vibrated in the polarity direction Y of the magnet 510.

In the device, the diaphragm 506 and the spring plate 511 are relatively moved through the magnetic combination between the voice coil 508 and the magnet 510. Consequently, when a low frequency signal or a high frequency signal is applied to the voice coil 508, both of the diaphragm 506 and the spring plate 511 are sequentially vibrated. As a result, sounds such as voice, music and others generated from the device are distorted, thereby reducing the quality of the sound. In addition, vibrating both of the voice coil 508 and the magnet 510 causes the low frequency vibration of the magnet to superimpose on the magnetic combination of the voice coil 508 and the magnet 510, which further largely distorts the sounds.

FIG. 7 is a sectional view showing a conventional multifunction acoustic device. The device comprises a speaker vibrating plate 603 made of plastic and having a corrugated periphery 603*a* and a central dome, a voice coil 604 secured to the underside of the vibrating plate 603 at a central portion, and a magnet composition 610. The vibrating plate 603 is secured to a frame 609 with adhesives.

The magnetic composition 610 comprises a lower yoke 605, a core 601 formed on the yoke 605 at a central portion thereof, an annular permanent magnet 602 mounted on the lower yoke 605, and an annular upper yoke 606 mounted on the permanent magnet 602. The lower yoke 605 and the upper yoke 606 are resiliently supported in the frame 609 by spring plates 607 and 608. A magnetic gap 611 is formed between a periphery 601*a* of the core 601 and an inside wall 606*a* of the upper yoke 606 to be magnetically connected to the voice coil 604.

When an alternating voltage is applied to the voice coil 604 through input terminals 612*a* and 612*b*, the speaker vibrating plate 603 is vibrated in the direction Y to generate sounds at a frequency between 700 Hz and 5 KHz. If a low frequency signal or a high frequency signal is applied to the voice coil 604, the speaker vibrating plate 603 and the magnetic composition 610 are sequentially vibrated, since the magnetic composition 610 and the speaker vibrating plate 603 are relatively moved through the magnetic combination of the voice coil 604 and the magnet composition 610.

As a result, sounds such as voice, music and others generated from the device are distorted, thereby reducing the quality of the sound. In addition, the driving of both the voice coil 604 and the magnetic composition 610 causes the low frequency vibration to superimpose on the magnetic combination of the voice coil 604 and the magnetic composition 610, which further largely distorts the sounds.

FIG. 8 is a sectional view showing another conventional multifunction acoustic device. The device comprises the speaker vibrating plate 603 made of plastic and having the corrugated periphery 603*a* and the central dome, the voice coil 604 secured to the underside of the vibrating plate 603 at a central portion, and the magnet composition 610. The vibrating plate 603 is secured to the frame 609 with adhesives.

The magnetic composition 610 comprises a lower yoke 703, core 601 formed on the yoke 703 at a central portion thereof, an annular permanent magnet 702 secured to the lower yoke 703, and annular upper yoke 606 having a peripheral wall 606*b* and mounted on the permanent magnet 702. The upper yoke 606 is resiliently supported in the frame 609 by spring plates 707 and 708. A first magnetic gap 701 is formed between the periphery 601*a* of the core 601 and the inside wall 606*a* of the upper yoke 606 to be magnetically connected to the voice coil 604. A second gap 705 is formed between a periphery 703*a* of the lower yoke 703 and inside wall 606*a* of the upper yoke 606. A driving coil 706 is secured to the frame and inserted in the second gap 705.

When an alternating voltage is applied to the voice coil 604 through input terminals 612*a* and 612*b*, the speaker vibrating plate 603 is vibrated in the direction Y to generate sounds at a frequency between 700 Hz and 5 KHz. If a low frequency signal or a high frequency signal is applied to the voice coil 604, the speaker vibrating plate 603 and the magnetic composition 610 are sequentially vibrated, since the magnetic composition 610 and the speaker vibrating plate 603 are relatively moved through the magnetic combination of the voice coil 604 and the magnet composition 610.

When a high frequency signal for music is applied to the voice coil 604, only the speaker vibrating plate 603 is vibrated. Therefore, there does not occur distortion of the sound. Furthermore, when a low frequency signal is applied to the driving coil 706, only the magnetic composition 610 is vibrated, and the speaker vibrating plate 603 is not vibrated.

However if a high frequency signal is applied to input terminals 612*a*, 612*b*, and a low frequency signal is also applied to input terminals 704*a*, 704*b*, the speaker vibrating plate 603 and magnetic composition 610 are sequentially vibrated, thereby reducing the sound quality.

In the above described conventional devices, both the speaker vibration plate and the magnetic composition are vibrated when a low frequency signal or a high frequency signal is applied to the voice coil. This is caused by the reason that the low frequency vibrating composition is vibrated in the same direction as the high frequency vibrating direction.

SUMMARY OF THE INVENTION

An object of the present invention is to provide a multifunction acoustic device in which a vibrating member is not vibrated together with another vibrating member, thereby removing disadvantages of conventional devices.

According to the present invention, there is provided a multifunction acoustic device comprising a frame, a rotor having an annular side yoke and rotatably supported in the frame, a stator having magnetic poles and provided in the frame, a first permanent magnet provided on the rotor for forming a gap, an annular second permanent magnet provided on the rotor outside the side yoke, a speaker vibrating plate supported in the frame, a voice coil secured to the speaker vibrating plate and inserted in the gap, at least one coil for forming magnetic fluxes between the rotor and the magnetic poles of the stator.

The rotor is rotatably mounted on the frame by a central shaft.

The device further comprises eccentric means provided on the rotor for vibrating the rotor during the rotation of the rotor.

The coil is disposed in the stator, and the first permanent magnet is an annular magnet around the shaft.

In an aspect of the invention, the eccentric means is a weight eccentrically provided in the rotor.

The device further comprises a central top yoke mounted on the first permanent magnet for forming the gap between the top yoke and the side yoke, and a driving circuit for energizing the coil for rotating the rotor.

The rotor comprises a lower rotor yoke rotatably mounted in the frame by the shaft, the side yoke secured to the lower rotor yoke, and the central top yoke, and the stator comprises a lower stator yoke and an upper stator yoke secured to the lower stator yoke.

In another aspect, the coil is disposed between the lower stator yoke and the upper stator yoke.

The rotor and the stator are formed into a synchronous motor, and the periphery of the second permanent magnet has a plurality of magnetic poles corresponding to the magnetic poles of the stator.

These and other objects and features of the present invention will become more apparent from the following detailed description with reference to the accompanying drawings.

DETAILED DESCRIPTION OF THE PREFERRED EMBODIMENT

Figure 1:
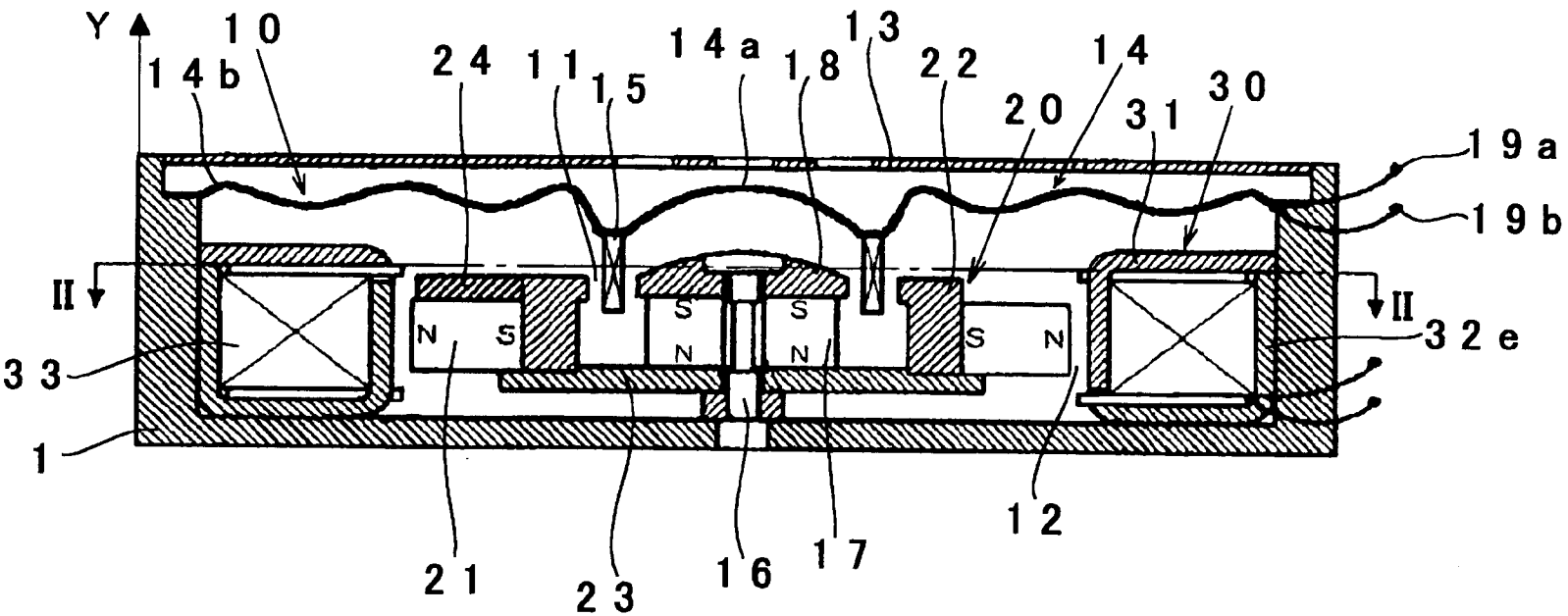
FIG. 1 is a sectional view of a multifunction acoustic device of the present invention.
Figure 2:
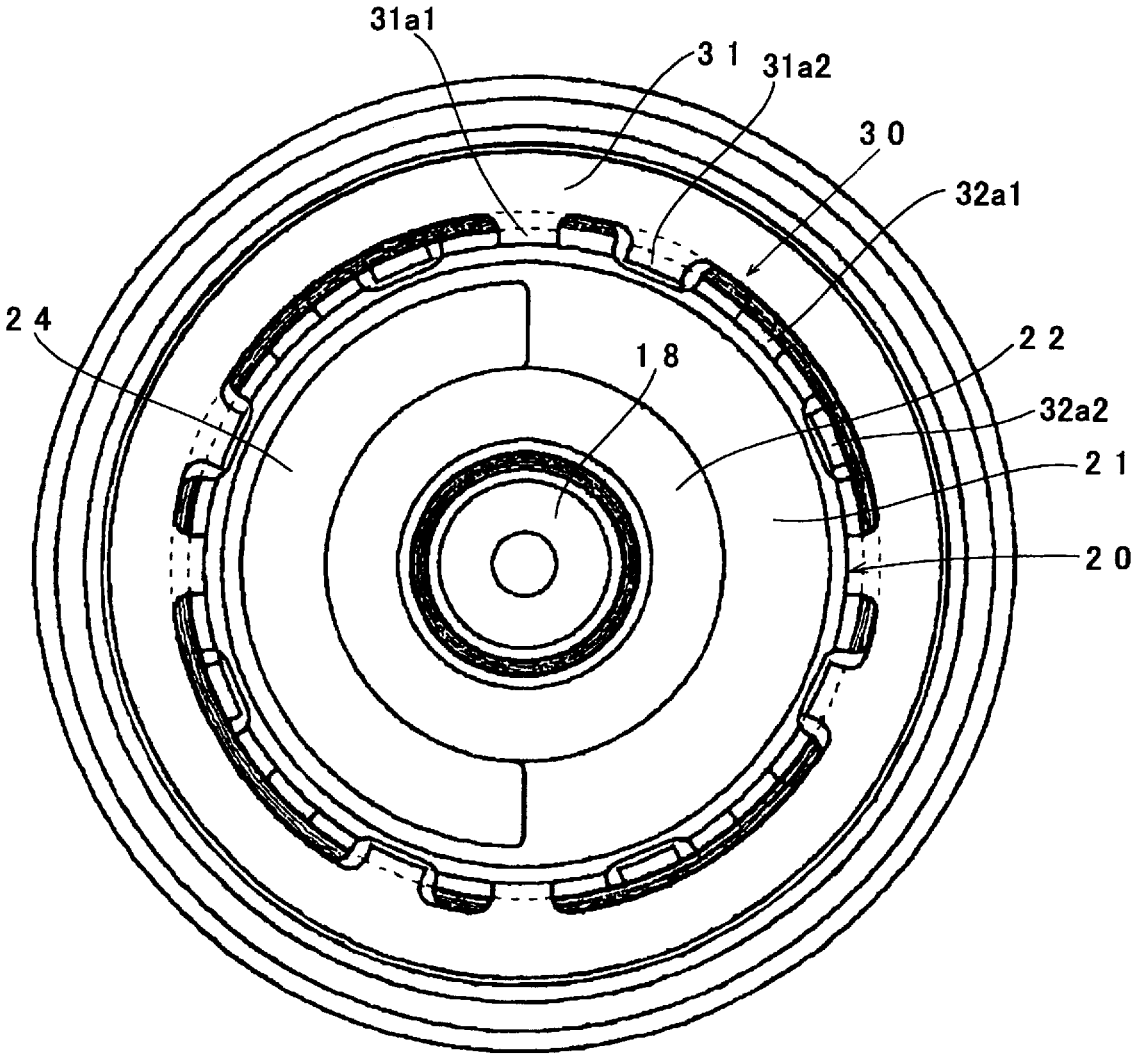
FIG. 2 is a sectional view taken along a line II—II of FIG. 1.

Referring to FIGS. 1 and 2, the multifunction acoustic device of the present invention comprises a sound generating device 10, a rotor 20 and an annular stator 30 provided in a cylindrical frame 1 made of plastic. The sound generating device 10 comprises a speaker vibrating plate 14 having a central dome 14*a* and secured to the frame at a periphery 14*b* with adhesives, a voice coil 15 secured to the underside of the speaker vibrating plate 14. The speaker vibrating plate 14 is covered by a cover 13 having a plurality of sound discharge holes and secured to the frame 1 at a peripheral edge thereof.

The rotor 20 comprises a lower rotor yoke 23 secured to a rotor shaft 16 rotatably mounted on a base plate of the frame 1, and an annular side yoke 22 secured to the lower rotor yoke 23. An annular speaker permanent magnet 17 is secured to the lower rotor yoke 23 around the shaft 16, and a central top yoke 18 is secured to the magnet 17 by the shaft 16. The speaker permanent magnet 17 is magnetized in single-polarity in the axial direction. Thus, a first magnetic circuit is formed between the top yoke 18 and the side yoke 22.

Figure 3:
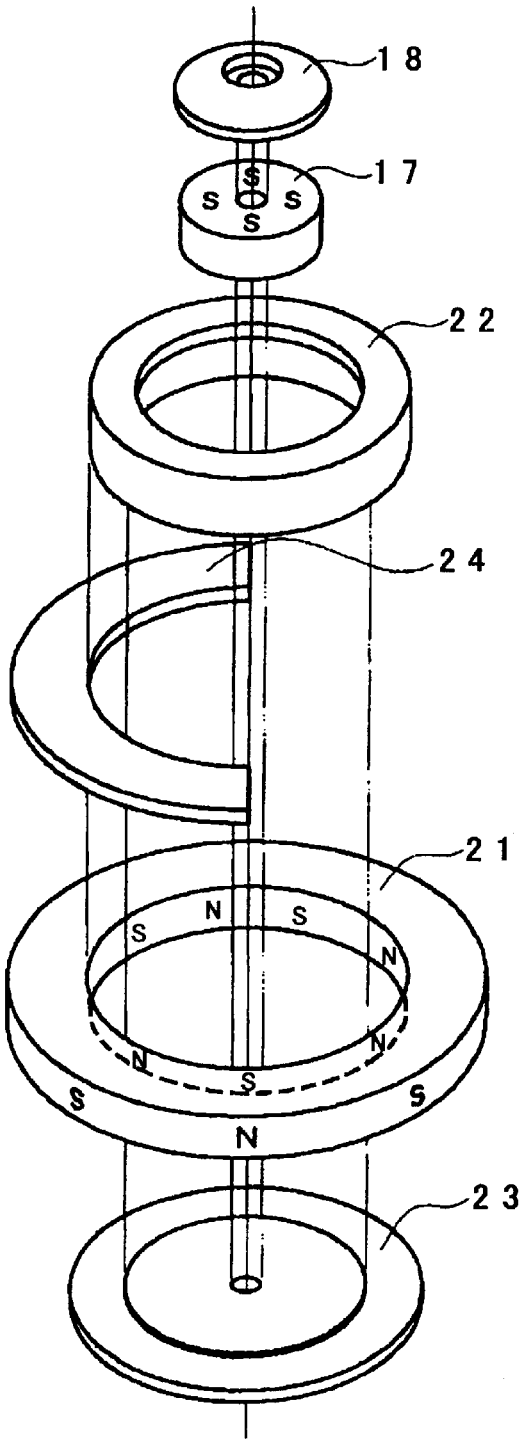
FIG. 3 is an exploded perspective view of a rotor of the multifunction acoustic device of the present invention.

An annular rotor permanent magnet 21 is secured to the peripheral wall of the side yoke 22 and to the lower rotor yoke 23. As shown in FIG. 3, the rotor permanent magnet 21 is magnetized in multiple-polarity in the radial direction, so that the peripheral wall of the rotor permanent magnet has a plurality of magnetic poles. Thus, a second magnetic circuit is formed between the rotor 20 and the stator 30. The voice coil 15 is disposed in a speaker gap 11 formed between the outside wall of the top yoke 18 and the inside wall of the side yoke 22.

As shown in FIGS. 2 and 3, a semicircular weight 24 made of plastic including heavy particles such as tungsten particles is secured to the outside wall of the side yoke 22 and mounted on the rotor permanent magnet 21. As another means, the permanent magnet 21 may be eccentrically disposed with respect to the rotor shaft 16. A motor gap 12 is formed between the periphery of the rotor permanent magnet 21 and the inside wall of the stator 30. As shown in FIGS. 1 and 2, the annular stator 30 is disposed around the rotor 20.

Figure 4:
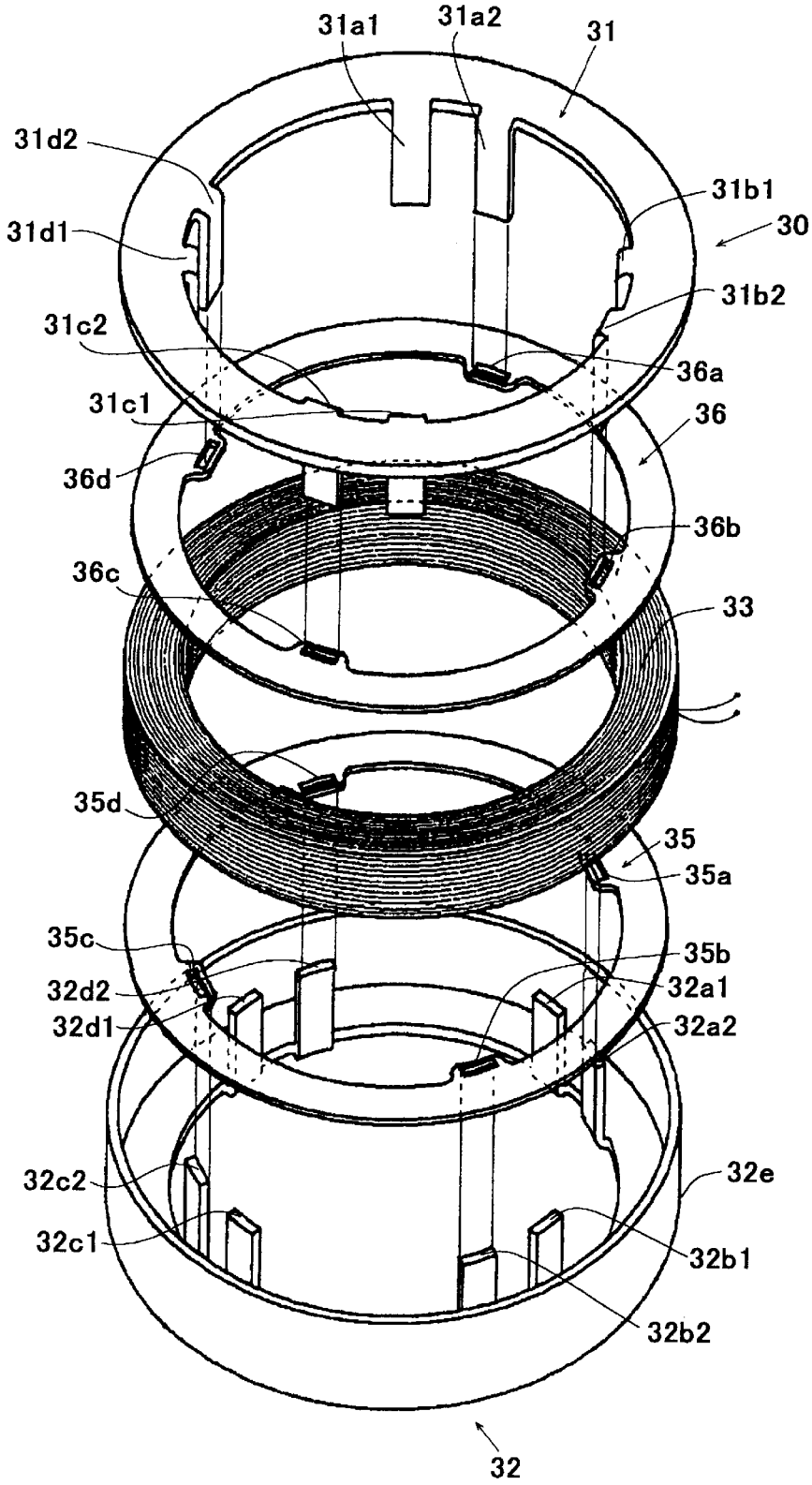
FIG. 4 is an exploded perspective view of a stator of the multifunction acoustic device of the present invention.

Referring to FIG. 4, the stator 30 comprises an annular stator coil 33, annular upper and lower shading plates 36 and 35 disposed on the upper and lower sides of the annular coil 33, and annular upper and lower stator yokes 31 and 32. The upper stator yoke 31 has four main magnetic poles 31*a*1, 31*b*1, 31*c*1 and 31*d*1, and four auxiliary magnetic poles 31*a*2, 31*b*2, 31*c*2 and 31*d*2. Each of the magnetic poles extends in the axial direction and toward the lower stator yoke 32. The lower stator yoke 32 has four main magnetic poles 32*a*1, 32*b*1, 32*c*1 and 32*d*1 and four auxiliary magnetic poles 32*a*2, 32*b*2, 32*c*2 and 32*d*2.

A couple of upper main and auxiliary magnetic poles 31*a*1 and 31*a*2 and a couple of lower main and auxiliary magnetic poles 32*a*1 and 32*a*2, and other couples of the magnetic poles are angularly disposed at one magnetic pole pitch of 90 degrees (electric angle 360°). The sum of widths of the main magnetic pole and the auxiliary magnetic pole is within 45 degrees, and the width of the main magnetic pole is larger than that of the auxiliary magnetic pole.

The couple of upper main and auxiliary magnetic poles and the couple of lower main and auxiliary magnetic poles are alternately disposed on the same circle as shown in FIG. 2.

The upper shading plate 36 has four holes 36*a*, 36*b*, 36*c* and 36*d*, each formed in a projection projected from the inside wall of the shading plate 36 in the radially inward direction. Similarly, the lower shading plate 35 has four holes 35*a*, 35*b*, 35*c* and 35*d*. The auxiliary magnetic poles 31*a*2, 31*b*2, 31*c*2 and 31*d*2 of the upper stator yoke 31 are inserted in the holes 36*a*–36*d* of the upper shading plate 36. Similarly, the auxiliary magnetic poles 32*a*2, 32*b*2, 32*c*2 and 32*d*2 of the lower stator yoke 32 are inserted in the holes 35*a*–35*d* of the lower shading plate 35.

Referring to FIGS. 1 and 4, the lower stator yoke 32 has a cylindrical peripheral wall 32*e*. The lower shading plate 35 is mounted on the lower stator yoke 32 between the peripheral wall 32*e* and main and auxiliary magnetic poles. The stator coil 33, upper shading plate 36, and upper stator plate 31 are stacked on the lower shading plate 35 in order. Thus, the rotor 20 and stator 30 are composed in a synchronous motor.

It will be understood that the motor can be made into a stepping motor having a permanent magnet rotor having multiple polarities.

The magnetomotive force of the permanent magnet 21 is applied to the speaker and motor gaps 11 and 12 in parallel, so that a necessary magnetic flux density is provided.

Figure 5:
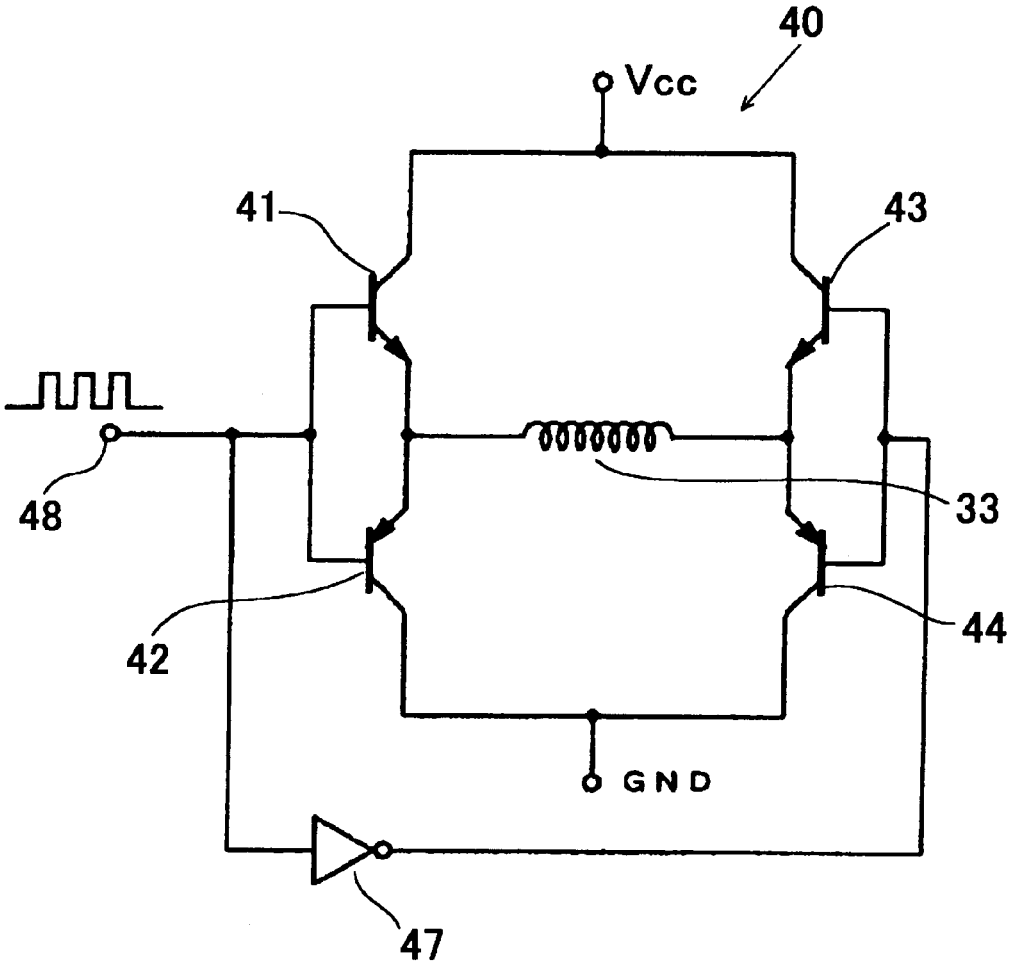
FIG. 5 is a driving circuit used in the multifunction acoustic device of the present invention.
Figure 6:
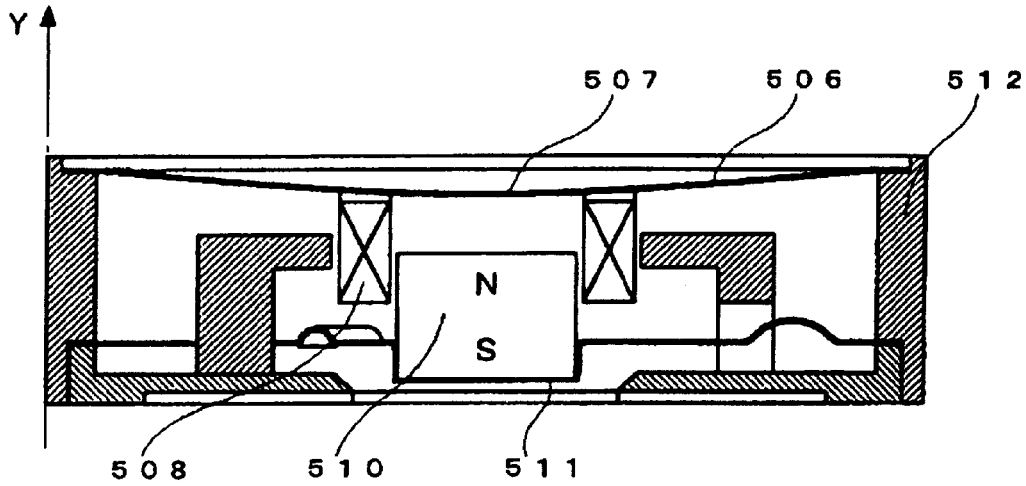
FIG. 6 PRIOR ART
FIG. 6 is a sectional view of a conventional electromagnetic induction converter.
Figure 7:
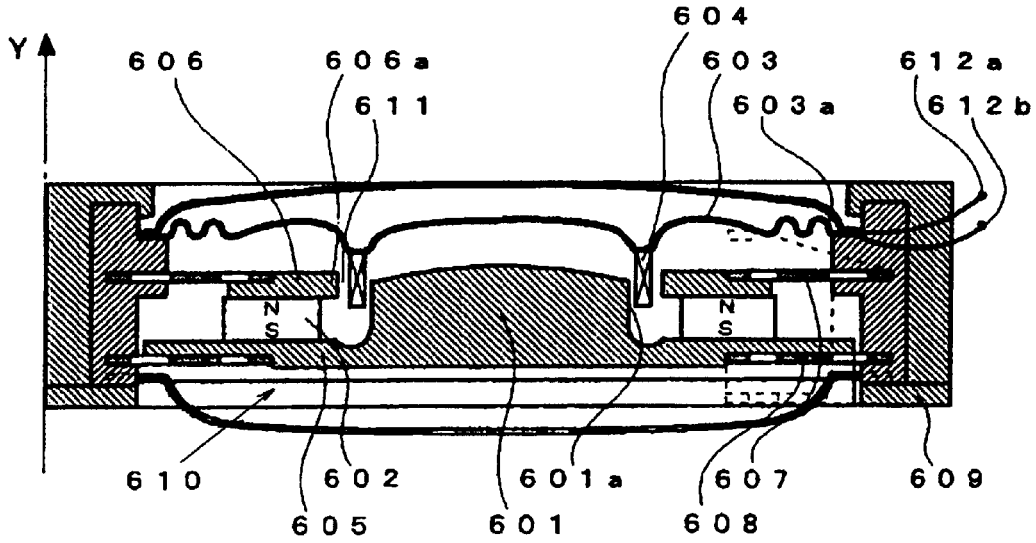
FIG. 7 PRIOR ART
FIG. 7 is a sectional view showing a conventional multifunction acoustic device.
Figure 8:
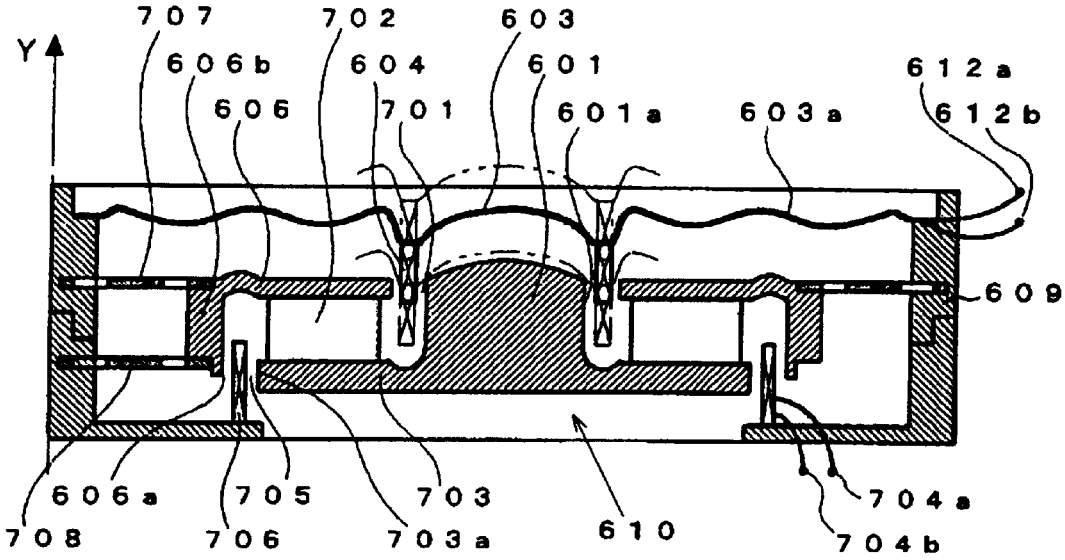
FIG. 8 PRIOR ART
FIG. 8 is a sectional view showing another conventional multifunction acoustic device.

Referring to FIG. 5, a rotor driving circuit 40 comprises a pair of NPN transistors 41 and 43 and a pair of PNP transistors 42 and 44 which are connected crosswise, interposing the stator coil 33. Bases of the transistors 41 and 42 are connected to an input terminal 48, bases of the transistors 43 and 44 are connected to the input terminal 48 through an inverter 47.

In operation, when a high frequency signal is applied to input terminals 19*a* and 19*b* (FIG. 1) of the voice coil 15, the speaker vibrating plate 14 is vibrated in the Y direction (FIG. 1) to generate sounds.

When a low frequency signal of about 100–300 Hz is applied to input terminal 48 of the driving circuit 40, the transistors 41 and 44 are turned on at a high level of the input signal. Consequently, a current passes the stator coil 33 through the transistors 41 and 44 from the Vcc to GND. And the current passes through the transistor 43, coil 33 and transistor 42 at a low level of the input signal. Thus, an alternate current of the low frequency corresponding to the input low frequency signal flows in the stator coil 33. Consequently, couples of main pole 32*a*1 and auxiliary pole 32*a*2 to poles 32*d*1 and 32*d*2 are energized. At that time, magnetic flux generated by four auxiliary poles 31*a*2, 31*b*2, 31*c*2 and 31*d*2, and magnetic flux generated by four auxiliary poles 32*a*2, 32*b*2, 32*c*2 and 32*d*2 are delayed in phase by eddy currents passing through holes 36*a*–36*d* of the upper shading plate 36 and holes 35*a*–35*d* of the lower shading plate 35 to produce a shifting magnetic field to generate rotating power in a predetermined direction. Thus, the rotor 20 is rotated at the driving low frequency. Since the weight 24 is eccentrically mounted on the rotor 20, the rotor vibrates in radial direction. The vibration is transmitted to user's body through the frame 1 and a case of the device so that a calling signal is informed to the user.

The number N of rotation of the rotor is expressed as follows.

$$N=60f/Z(\text{rpm}) \quad 1$$

where Z is a pair of number of poles of the rotor, f is driving frequency.

The load torque TL is expressed as follows.

$$TL=\mu rR\omega^2M(N\cdot m) \quad 2$$

where M is the mass of weight 24 of the rotor,

R is the length between the center of the rotor shaft 16 and the center of gravity of the weight 24, r is the radius of the rotor shaft 16, $\mu$ is the friction coefficient between the rotor shaft 16 and the rotor 20, $\omega$ is the number of rotation (rad/sec) of the rotor 20.

Since the rotor 20 merely bears the load torque TL, the power consumption of the device is small.

If a lower frequency signal is applied to the input terminal 48 to rotate the rotor 20 during the generating sounds by the speaker vibrating plate 14, the magnetic flux density in the first gap 11 does not change from the magnetic flux density when only the speaker vibrating plate 14 is vibrated. Therefore, quality of sounds generated by the vibrating plate does not reduce even if the rotor 20 rotates.

Although the synchronous motor is used in the above described embodiments, other motors such as a stepping motor, a direct current motor and others can be used. Further, the rotor can be disposed outside the stator.

From the foregoing description, it will be understood that the present invention provides a multifunction acoustic device which may generate sounds and vibration of the frame at the same time without reducing sound quality. In the prior art, since the speaker vibrating plate and the magnetic composition are vibrated in the same direction, the thickness of the device increases. In the device of the present invention, since the magnetic composition rotates, the thickness of the device can be reduced.

While the invention has been described in conjunction with preferred specific embodiment thereof, it will be understood that this description is intended to illustrate and not limit the scope of the invention, which is defined by the following claims.

What is claimed is:

1. A multifunction acoustic device, comprising:

a frame;

a rotor having an annular side yoke and rotatably supported in the frame;

a stator having magnetic poles and provided in the frame;

a first permanent magnet provided on the rotor for forming a gap;

an annular second permanent magnet provided on the rotor outside the side yoke;

a speaker vibrating plate supported in the frame;

a voice coil secured to the speaker vibrating plate and inserted in the gap;

at least one coil for forming magnetic fluxes between the rotor and the magnetic poles of the stator.

2. The device according to claim 1 wherein the rotor is rotatably mounted on the frame by a central shaft.

3. The device according to claim 1 further comprising eccentric means provided on the rotor for vibrating the rotor during the rotation of the rotor.

4. The device according to claim 1 wherein the coil is disposed in the stator.

5. The device according to claim 2 wherein the first permanent magnet is an annular magnet around the shaft.

6. The device according to claim 3 wherein the eccentric means is a weight eccentrically provided in the rotor.

7. The device according to claim 5 further comprising a central top yoke mounted on the first permanent magnet for forming the gap between the top yoke and the side yoke.

8. The device according to claim 7 further comprising a driving circuit for energizing the coil for rotating the rotor.

9. The device according to claim 8 wherein the rotor comprises a lower rotor yoke rotatably mounted in the frame by the shaft, the side yoke secured to the lower rotor yoke, and the central top yoke, and the stator comprises a lower stator yoke and an upper stator yoke secured to the lower stator yoke.

10. The device according to claim 9 wherein the coil is disposed between the lower stator yoke and the upper stator yoke.

11. The device according to claim 10 wherein the rotor and the stator are formed into a synchronous motor.

12. The device according to claim 10 wherein the periphery of the second permanent magnet has a plurality of magnetic poles corresponding to the magnetic poles of the stator.

* * * * *